US009200354B2

(12) United States Patent
Daitoh et al.

(10) Patent No.: US 9,200,354 B2
(45) Date of Patent: Dec. 1, 2015

(54) ROLLED STEEL BAR OR WIRE FOR HOT FORGING

(75) Inventors: Yoshihiro Daitoh, Tokyo (JP); Hideki Imataka, Tokyo (JP); Masayuki Horimoto, Tokyo (JP); Akira Shiga, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 293 days.

(21) Appl. No.: 13/989,847

(22) PCT Filed: Nov. 28, 2011

(86) PCT No.: PCT/JP2011/077407

§ 371 (c)(1),
(2), (4) Date: May 28, 2013

(87) PCT Pub. No.: WO2012/073896

PCT Pub. Date: Jun. 7, 2012

(65) Prior Publication Data

US 2013/0243641 A1 Sep. 19, 2013

(30) Foreign Application Priority Data

Nov. 29, 2010 (JP) ..... 2010-265760

(51) Int. Cl.

| | |
|---|---|
| ***C22C 38/18*** | (2006.01) |
| ***C22C 38/22*** | (2006.01) |
| ***C22C 38/50*** | (2006.01) |
| ***C21D 6/00*** | (2006.01) |

(Continued)

(52) U.S. Cl.

CPC . *C22C 38/50* (2013.01); *C21D 6/00* (2013.01); *C21D 8/0226* (2013.01); *C21D 8/065* (2013.01); *C21D 9/32* (2013.01); *C21D 9/52* (2013.01); *C22C 1/02* (2013.01); *C22C 38/001* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/28* (2013.01); *C22C 38/42* (2013.01); *C22C 38/44* (2013.01); *C21D 2211/002* (2013.01); *C21D 2211/005* (2013.01); *C21D 2211/009* (2013.01)

(58) Field of Classification Search

None

See application file for complete search history.

(56) References Cited

FOREIGN PATENT DOCUMENTS

| | | |
|---|---|---|
| JP | 60-21359 | 2/1985 |
| JP | 07-126803 | 5/1995 |

(Continued)

OTHER PUBLICATIONS

Machine-English translation of Japanese patent No. 2010-168628. Ichinomiya Katsuyuki et al., Aug. 5, 2010.*

*Primary Examiner* — Deborah Yee

(74) *Attorney, Agent, or Firm* — Clark & Brody

(57) ABSTRACT

A rolled steel bar or a wire rod for hot forging capable of coping with both bending/surface fatigue strength of components and machinability at a high level includes: a composition containing, in mass %, C: 0.1 to 0.25%, Si: 0.01 to 0.10%, Mn: 0.4 to 1.0%, S: 0.003 to 0.05%, Cr: 1.60 to 2.00%, Mo: 0.10% or less (including 0%), Al: 0.025 to 0.05%, and N: 0.010 to 0.025%, where a value of fn1 represented in a following formula (1) satisfies $1.82 \leq fn1 \leq 2.10$: $fn1 = Cr + 2 \times Mo$ (1); impurities containing P: 0.025% or less, Ti: 0.003% or less, and O (oxygen): 0.002% or less; and a cross section in which a maximum value/a minimum value of an average ferrite grain diameter is 2.0 or less when measurement by observation is randomly carried out in 15 visual fields with an area per visual field set to be 62500 $\mu m^2$.

4 Claims, 2 Drawing Sheets

SMALL ROLLER SPECIMEN
FOR ROLLER PITCHING TEST

(51) Int. Cl.

| | |
|---|---|
| ***C21D 9/32*** | (2006.01) |
| ***C21D 9/52*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |
| ***C22C 38/20*** | (2006.01) |
| ***C22C 38/26*** | (2006.01) |
| ***C22C 38/42*** | (2006.01) |
| ***C22C 38/44*** | (2006.01) |
| ***C21D 8/02*** | (2006.01) |
| ***C21D 8/06*** | (2006.01) |
| ***C22C 1/02*** | (2006.01) |

(56) References Cited

FOREIGN PATENT DOCUMENTS

| | | |
|---|---|---|
| JP | 07-242994 | 9/1995 |
| JP | 2001-152284 | 6/2001 |
| JP | 2009-052062 | 3/2009 |
| JP | 2010-168628 | 8/2010 |

* cited by examiner

SMALL ROLLER SPECIMEN
FOR ROLLER PITCHING TEST

ONO-TYPE ROTATING BENDING FATIGUE TEST

LARGE ROLLER SPECIMEN FOR ROLLER PITCHING TEST

ROLLED STEEL BAR OR WIRE FOR HOT FORGING

TECHNICAL FIELD

The present invention relates to a rolled steel bar or a wire rod for hot forging for use as starting material of a component such as a gear and a pulley. More specifically, the present invention relates to a rolled steel bar or a wire rod for hot forging roughly formed through hot forging, which are excellent in machinability before carburizing or carbonitriding, and also excellent in bending fatigue strength and surface fatigue strength of a carburized or carbonitrided component.

BACKGROUND ART

Conventional steel components such as gears and pulleys of automobiles or industrial machinery are made by using, as starting materials, rolled steel bars or wire rods of alloy steel for mechanical structures such as SCr420, SCM 420, and SNCM 420 specified by JIS standard, which are roughly formed through hot forging or cold forging. After normalized if necessary, the roughly formed rolled steel bars or the wire rods are machined, and then carburizing-quenched or carbonitriding-quenched, and thereafter are tempered at a temperature of not more than 200° C. The rolled steel bars or the wire rods are further subjected to shot peening processing if necessary for production, thereby securing a property required for each component such as contact fatigue strength, bending fatigue strength, and wear resistance.

Due to recent progress in weight reduction and size reduction of components in order to achieve improvement of fuel efficiency of automobiles and high output performance of engines, load applied to the components tends to be increased. Meanwhile, in the light of cost reduction, there are also strong needs to omit additional surface processing such as shot peening after carburizing-quenching. There are also strong needs to enhance machinability because the percentage of machining cost in the total processing cost of components is great.

It is common to add more alloying elements in order to enhance fatigue strength of components, but this often deteriorates machinability. Hence, it has been desired to cope with both bending/contact fatigue strength and machinability of the components at a high level.

The aforementioned "contact fatigue" includes "surface fatigue", "linear fatigue", and "point fatigue", but there barely occur a "linear" contact or a "point" contact in reality; thus the "surface fatigue strength" is handled as the contact fatigue strength.

Pitching is one of fracture morphologies of the surface fatigue, and the damage morphology of the surface fatigue caused on a surface tooth of a gear or a pulley, etc., is chiefly pitching. Hence, enhancement of the pitching strength corresponds to enhancement of the aforementioned surface fatigue strength, and thus the "pitching" will be described as the "surface fatigue", and the "pitching strength" is referred to as the "surface fatigue strength", hereinafter.

JP60-21359A, JP7-242994A, JP7-126803A suggest improvement of steel for gears. Specifically, JP60-21359A discloses steel for gears specified to contain Si: not more than 0.1% and P: not more than 0.01% so as to provide gears excellent in strength and stiffness, and having high reliability. JP7-242994A discloses steel for gears, gears, and a method of producing the gears specified to contain Cr: 1.50 to 5.0%, and 7.5%>2.2×Si(%)+2.5×Mn(%)+Cr(%)+5.7×Mo(%) if necessary, or Si: 0.40 to 1.0% so as to be excellent in tooth surface strength. JP7-126803A discloses carburized steel for gears specified to contain Si: 0.35 to not more than 3.0%, and V: 0.05 to 0.5% so as to be preferable to provide gears excellent in wear resistance and surface fatigue strength as well as bending fatigue strength.

DISCLOSURE OF THE INVENTION

Since no account is taken for the surface fatigue strength in JP60-21359A, the surface fatigue strength is insufficient. Since no account is taken for the bending fatigue strength in JP7-242994A, the bending fatigue strength is insufficient. The machinability is also insufficient. Since sufficient account is not taken for the bending fatigue strength in JP7-126803A, the bending fatigue strength is insufficient. Since V-addition significantly increases hardness of steel after hot forging, the machinability is also insufficient.

As described in JP60-21359A, JP7-242994A, and JP7-126803A, it has been well known that adjustment of contents of Si and Cr produces steel material excellent in bending/surface fatigue strength after carburizing or carbonitriding. In general, it is, however, difficult to cope with both the banding/surface fatigue strength and the machinability at a high level, which conflict with each other.

An object of the present invention is to provide a rolled steel bar or a wire rod for hot forging to be roughly formed through hot forging, which is capable of coping with both machinability and bending/surface fatigue strength of a carburizing-quenched or carbonitriding-quenched component at a high level.

SOLUTION TO PROBLEM AND ADVANTAGEOUS EFFECTS OF INVENTION

The rolled steel bar or the wire rod for hot forging according to the present invention includes: a composition containing, in mass %, C: 0.1 to 0.25%, Si: 0.01 to 0.10%, Mn: 0.4 to 1.0%, S: 0.003 to 0.05%, Cr: 1.60 to 2.00%, Mo: 0.10% or less (including 0%), Al: 0.025 to 0.05%, and N: 0.010 to 0.025%, in which contents of Cr and Mo satisfies $1.82 \leq fn1 \leq 2.10$ if a value of fn1 expressed by a following formula (1) is given: $fn1 = Cr + 2 \times Mo$ (1), where an symbol of each element in the formula (1) represents a content of the element in mass %; a balance being Fe and impurities having a composition containing P: 0.025% or less, Ti: 0.003% or less, and O (oxygen): 0.002% or less; a structure including any one of a ferrite-pearlite structure, a ferrite-pearlite-bainite structure, and a ferrite-bainite structure; and a cross section in which a maximum value/a minimum value of an average ferrite grain diameter is 2.0 or less when measurement by observation is randomly carried out in 15 visual fields with an area per visual field set to be 62500 $\mu m^2$.

The rolled steel bar or the wire rod for hot forging according to the present invention can cope with both machinability and bending/surface fatigue strength of a carburizing-quenched or carbonitriding-quenched component at a high level.

The rolled steel bar or the wire rod for hot forging according to the present invention may contain Nb: 0.080 or less in mass % instead of part of Fe.

The rolled steel bar or the wire rod for hot forging according to the present invention may contain at least one of Cu: 0.4% or less and Ni: 0.8% or less in mass % instead of part of Fe.

DESCRIPTION OF EMBODIMENTS

Figure 1:
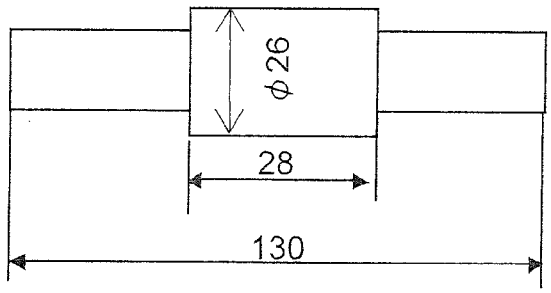
FIG. 1 is a side view showing dimensions and a shape of a small roller specimen for a roller pitching test produced in Examples.

As explained above, it has been well known that adjustment of contents of Si and Cr or the like produces steel materials excellent in the bending/surface fatigue strength after carburizing or carbonitriding. In general, it is, however, impossible to cope with both the bending/surface fatigue strength and the machinability at a high level, which conflict with each other. To counter this problem, various investigations and studies have been conducted to aim for development of a rolled steel bar or a wire rod for hot forging capable of coping with both the bending/surface fatigue strength and the machinability at a high level, and as a result, the following findings have been obtained.

(a) In order to enhance the bending fatigue strength, it is effective to reduce the Si content, but it is not sufficient, and the Cr content and the Mo content should be increased.

(b) In order to enhance the surface fatigue strength, the Cr content and the Mo content should be increased.

(c) Increase in the Mo content encourages production of a bainitic structure as well as a ferrite structure and a perlite structure after the hot forging or after further normalizing, which causes hardening, and deteriorates the machinability. Too excessive Cr content even with adding no Mo also encourages production of the bainitic structure, which deteriorates the machinability.

(d) The composition range to cope with all the bending fatigue strength, the surface fatigue strength, and the machinability at a high level is narrow, and it is required to limit each content of Si, Cr and Mo, and also to limit the range of "Cr %+2×Mo %".

(e) If the grain diameter in the rolled steel bar or the wire rod for hot forging is ununiform, both the bending fatigue strength and the surface fatigue strength tend to become deteriorated. The ununiformity of the grain diameter can be evaluated by using the ferrite grain diameter.

The rolled steel bar or the wire rod for hot forging of the present invention has been accomplished based on the above findings. Detailed description will be provided on the present invention, hereinafter. The symbol "%" for a content of a chemical composition denotes "mass %".

(A) Chemical Composition

C: 0.1 to 0.25%

C is an essential element to secure core strength of a carburizing-quenched or carbonitriding-quenched component. The C content of less than 0.1% is insufficient. On the other hand, the C content of more than 0.25% significantly increase amount of distortion of the component when the component is carburizing-quenched or carbonitriding-quenched. Accordingly, the C content is set to be 0.1 to 0.25%. It is preferable to set the C content to be 0.18% or more, and also to be 0.23% or less.

Si: 0.01 to 0.10%

Si is an element serving for enhancing hardenability. On the other hand, Si causes increase of the intergranularly oxidation layers at the time of carburizing or carbonitriding treatment. In particular, if the Si content is more than 0.10%, the intergranularly oxidation layers are drastically increased, which deteriorates the bending fatigue strength, and it becomes impossible to satisfy a target value of the present invention. The Si content of less than 0.01% provides an insufficient effect for enhancement of hardenability. Hence, the Si content is set to be 0.01 to 0.10%. It is preferable to set the Si content to be 0.06 to 0.10%.

Mn: 0.4 to 1.0%

Mn has a great effect for enhancement of hardenability, and is an essential element to secure core strength of a carburizing-quenched or carbonitriding-quenched component. The Mn content of less than 0.4% is insufficient. On the other hand, the Mn content of more than 1.0% not only saturates its effect but also causes significant deterioration of the machinability after the hot forging. Hence, the Mn content is set to be 0.4 to 1.0%. It is preferable to set the Mn content to be 0.5% or more, and more preferably to be 0.6% or more. It is also preferable to set the Mn content to be 0.9% or less.

S: 0.003 to 0.05%

S combines with Mn to generate MnS, and is an effective element for enhancement of the machinability. If the S content is less than 0.003%, the above effect is hardly obtained. On the other hand, as the S content becomes increased, coarse MnS is more likely to be produced, which tends to deteriorate the fatigue strength. The S content of more than 0.05% causes significant deterioration of the fatigue strength. Accordingly, the S content is set to be 0.003 to 0.05%. It is preferable to set the S content to be 0.01% or more, and also to be 0.02% or less.

Cr: 1.60 to 2.00%

Cr has a great effect for enhancement of hardenability and temper softening resistance, and is an effective element for enhancement of the bending fatigue strength and the surface fatigue strength. The Cr content of less than 1.60% cannot achieve the target bending fatigue strength and surface fatigue strength even if the Mo content is 0.10%. On the other hand, the Cr content of more than 2.00% likely causes production of the bainitic structure after the hot forging or normalizing, which deteriorates the machinability. Accordingly, the Cr content is set to be 1.60 to 2.00%. It is preferable to set the Cr content to be 1.80% or more, and also to be 1.90% or less.

Mo: 0.10% or Less (Including 0%)

Mo is not necessarily added, but has a great effect for enhancement of hardenability and temper softening resistance, and Mo is an effective element for enhancement of the bending fatigue strength and the surface fatigue strength. If the Cr content is less than 1.82%, it is possible to achieve the target bending fatigue strength and surface fatigue strength by adjusting the Mo content such that "Cr %+2×Mo %" becomes 1.82 or more. On the other hand, the Mo content of more than 0.10% encourages production of the bainitic structure after the hot forging or normalizing, and deteriorates the machinability. Accordingly, the Mo content is set to be 0.10% or less (including 0%). It is preferable to set the Mo content to be 0.02% or more so as to secure the above effect.

Al: 0.025 to 0.05%

Al has a deoxidation effect, and easily combines with N to generate AlN, and Al is an effective element for preventing austenite grains from coarsening at the time of heating for carburizing. The Al content of less than 0.025%, however, cannot stably prevent the austenite grains from coarsening, and if the austenite grains become coarse, the bending fatigue strength becomes deteriorated. On the other hand, the Al content of more than 0.05% likely causes production of coarse oxide, which deteriorates the bending fatigue strength. Accordingly, the Al content is set to be 0.025 to 0.05%. It is preferable to set the Al content to be 0.030% or more, and also to be 0.040% or less.

N: 0.010 to 0.025%

N is an element easily combining with Al and Nb to generate AlN and NbN. In the present invention, AlN and NbN are effective to prevent the austenite grains from coarsening at the time of heating for carburizing. The N content of less than 0.010% cannot stably prevent the austenite grains from coarsening. On the other hand, if the N content is more than 0.025%, it is difficult to realize stable mass production in a steel manufacturing process. Accordingly, the N content is set to be 0.010 to 0.025%. It is preferable to set the N content to be 0.018% or less.

The balance of the chemical composition of the rolled steel bar or the wire rod for hot forging according to the present invention contains Fe and impurities. The impurities herein denote elements mixed through minerals or scraps used as row materials of steel, or an environment of the manufacturing process and the like. In the present invention, the contents of P, Ti and O (oxygen) as impurity elements are limited as follows.

P: 0.025% or Less

P is an element that likely causes grain-boundary segregation and embrittlement of the grain boundaries. The P content of more than 0.025% deteriorates the fatigue strength. Accordingly, the P content is set to be 0.025% or less. It is preferable to set the P content to be 0.020% or less.

Ti: 0.003% or Less

Ti easily combines with N to generate hard and coarse TiN, and TiN serves as a cause to deteriorate the fatigue strength. The Ti content of more than 0.003% significantly deteriorates the fatigue strength. It is preferable to adjust the Ti content as an impurity element to be as small as possible, but in the light of the steel manufacturing cost, it is preferable to set the Ti content to be 0.002% or less.

O (Oxygen): 0.002% or Less

O easily combines with Al to generate hard oxide-based inclusions, and the oxide-based inclusions serves as a cause to deteriorate the bending fatigue strength. The O content of more than 0.002% significantly deteriorates the fatigue strength. It is preferable to adjust the O content as an impurity element as small as possible, but in the light of the steel manufacturing cost, it is preferable to set the O content to be 0.0010 or less.

$fn1=Cr+2\times Mo$: 1.82 to 2.10

As described above, Cr and Mo have a great effect to enhance hardenability and temper softening resistance, and are effective elements to enhance the bending fatigue strength and the surface fatigue strength. Note that since Mo attains the same effect as that of Cr with half content of the Cr content, a value of fn1 is defined to be $fn1=Cr+2\times Mo$. To each symbol of the elements (Cr, Mo) in fn1, a content of a concerned element in mass % of the concerned element is assigned. If the value of fn1 is less than 1.82, it is impossible to attain the target bending fatigue strength and surface fatigue strength. The value of fn1 of more than 2.10 encourages production of the bainitic structure after the hot forging or the normalizing, and deteriorates the machinability. Accordingly, the value of fn1 is set to be 1.82 to 2.10. The preferable upper limit of the value of fn1 is less than 2.00.

In the present invention, the following elements may be added so as to obtain a more excellent property.

Nb: 0.080 or Less

Nb easily combines with C and N to generate NbC, NbN, and Nb(C,N), and is an effective element to supplement the prevention of the coarsening of the austenite grains at the time of heating for carburizing due to AlN, as aforementioned. On the other hand, the Nb content of more than 0.08% rather deteriorates the effect to prevent the austenite grains from coarsening. Accordingly, the Nb content is set to be 0.08% or less. In order to secure this effect, it is preferable to set the Nb content to be 0.01% or more. The preferable Nb content is 0.05% or less.

The steel bar or the wire rod according to the present embodiment may contain at least one of Cu and Ni instead of part of Fe. Both Cu and Ni enhance the hardenability as well as the fatigue strength.

Cu: 0.4% or Less

Cu has an effect to enhance the hardenability, and is an effective element to further enhance the fatigue strength, so that Cu may be contained if necessary. The Cu content of more than 0.4%, however, deteriorates hot ductility, and causes significant deterioration of hot workability. Accordingly, if Cu is contained, the Cu content is set to be 0.4% or less. If Cu is contained, it is preferable to set the Cu content to be 0.3% or less. The preferable lower limit of the Cu content is 0.1% or more.

Ni: 0.8% or Less

Ni has an effect to enhance the hardenability, and is an effective element to further enhance the fatigue strength, so that Cu may be contained if necessary. The Ni content of more than 0.8%, however, saturates the effect to enhance the fatigue strength due to the enhancement of the hardenability. In addition, the machinability after the hot forging becomes significantly deteriorated, and the alloy cost becomes increased, as well. Accordingly, if Ni is contained, the Ni content is set to be 0.8% or less. If Ni is contained, the Ni content is preferably set to be 0.6% or less. The preferable lower limit of the Ni content is 0.1% or more.

(B) Microstructure

It can be considered that a tendency of ununiformity of the grain diameter in the phase of the hot rolled material (as-hot-rolled material) is succeeded after the hot forging and also after the carburizing-quenching, so that this tendency may affect the bending fatigue strength and the surface fatigue strength. Hence, an investigation was conducted on the relation between the ununiformity of the grain diameter in the hot rolled material, and the bending fatigue strength and the surface fatigue strength after the carburizing-quenching. An index for evaluating the ununiformity of the grain diameter is defined by using a maximum value/a minimum value of an average ferrite grain diameter in each visual field. The reason for employing the ferrite grain diameter is that the grain boundaries of the ferrite grains can be observed more easily through etching processing, compared to pearlite and bainite grains, so that the employment of the ferrite grain diameter facilitates evaluation on ununiformity of the structure. The reason for using the maximum value/the minimum value as the evaluation index is because it can be considered that it is more appropriate to use this value as the evaluation index than to use a standard deviation since breakage occurs at a position having a smallest fatigue strength as a starting point of the breakage.

Accordingly, the microstructure should be appropriately formed. Specifically, in the hot-rolled material, if its structure is constituted by the ferrite-pearlite structure, the ferrite-pearlite-bainite structure, or the ferrite-bainite structure, and if the maximum value/the minimum value of the average ferrite grain diameter in each visual field is 2.0 or less when measurement by observation is randomly carried out in 15 visual fields of the cross section with an area per visual field set to be 62500 $\mu m^2$, it is possible to enhance the bending fatigue strength and the surface fatigue strength after the carburizing-quenching.

The "ferrite-pearlite structure" herein denotes a two phase structure consisting of ferrite and pearlite. The "ferrite-pearlite-bainite structure" herein denotes a three phase structure consisting of ferrite, pearlite, and bainite. The "ferrite-bainite structure" herein denotes a two phase structure consisting of ferrite and bainite.

If martensite is included in the structure, cracking is likely caused during straightening or transporting the hot-rolled steel bar or the wire rod because martensite is hard, and has low ductility.

If the structure is one of the above various mixed structures that include the aforementioned ferrite structure, and the maximum value/the minimum value of the average ferrite grain diameter is 2.0 or less, there occur only small variations in the grain diameter in the cross section in the phase of the rolled steel bar or the wire rod for hot forging (as-hot-rolled material), and it is possible to enhance the bending fatigue strength and the surface fatigue strength after the carburizing-quenching.

Each "phase" in the above structures is identified such that a section (cross section) is formed by cutting the rolled steel bar or the wire rod for hot forging vertically in its longitudinal direction while including its center portion, and thereafter, the sectional surface is so mirror-polished and Nital-etched as to be formed as a specimen. The specimen is then randomly observed in 15 visual fields with each visual field set to be 250 μm×250 μm at the magnification of 400 times. Based on the average ferrite grain diameter for each visual field obtained through an image analysis using a common method as to each of the visual fields, the maximum value/the minimum value is calculated. The maximum value/the minimum value is preferably 1.6 or less. In the measurement of the average ferrite grain diameter in the above cross section, the observation is conducted on an area excluding a decarburized layer of an outer layer of the cross section.

As one example of the production method for obtaining the rolled steel bar or the wire rod for hot forging of the present invention, the case of using steel having the chemical composition described in the above (A) will be described. The method for producing the rolled steel bar or the wire rod for hot forging of the present invention is, however, not limited to this example.

The steel having the above chemical composition is molten to produce a cast piece. The cast piece is subjected to rolling reduction while being solidified. The produced cast piece in this manner is then bloomed into a billet. At this time, the cast piece is heated at a temperature from 1250 to 1300° C. for ten hours or more, and then is bloomed. The produced billet is hot-rolled into the rolled steel bar or the wire rod for hot forging. At this time, the billet is heated at a temperature of 1150 to 1200° C. for 1.5 hours or more, and then is hot-rolled. The finishing temperature of the hot rolling is set at 900 to 1000° C., and no water-cooling is applied before the finish rolling, and after the finish rolling, the rolled bar or the wire rod is cooled down to a temperature of not more than 600° C. at a cooling speed of not more than allowing-cooling in the air (referred to as simply "allowing-cooling", hereinafter). The reduction of area from the billet into the rolled steel bar or the wire rod ({1−(area of cross section of the rolled steel bar or the wire rod/area of cross section of the billet)}×100) is set to be 87.5% or more.

After the finish rolling in the hot rolling, the rolled bar or the wire rod is not necessarily cooled down to a room temperature at the cooling speed of not more than the allowing-cooling, and when the temperature reaches 600° C. or less, the rolled steel bar or the wire rod may be then cooled down through an appropriate cooling method such as air-cooling, mist-cooling, and water-cooling.

In the present specification, the heating temperature denotes an average value of an in-furnace temperature of the reheating furnace, and the heating time denotes in-furnace time. The finishing temperature of the hot rolling denotes a surface temperature of the rolled steel bar or the wire rod immediately after the finish rolling, and the cooling speed after the finish working denotes a surface cooling speed of the rolled steel bar and the wire rod.

The rolled steel bar or the wire rod for hot forging of the present invention can cope with both the machinability and the bending/surface fatigue strength of the component at a high level.

Detailed description will be provided on the present invention using Examples, hereinafter.

Example 1

Quality governing was applied to steels A to C having the chemical compositions shown in Table 1 in a 70-ton converter, and rectangular blooms of 400 mm×300 mm were obtained through continuous casting, and the blooms were cooled down to 600° C. or less.

TABLE 1

| | Chemical Composition (mass %) Balance: Fe and Inevitable Impurities | | | | | | | | | | | |
|---|---|---|---|---|---|---|---|---|---|---|---|---|
| Steel | C | Si | Mn | P | S | Cr | Mo | Al | Ti | N | O | Cr + 2 · Mo |
| A | 0.21 | *0.21 | 0.86 | 0.012 | 0.013 | *1.08 | — | 0.029 | 0.001 | 0.0157 | 0.0012 | *1.08 |
| B | 0.21 | *0.19 | 0.78 | 0.013 | 0.014 | *1.02 | *0.36 | 0.031 | 0.002 | 0.0161 | 0.0011 | *1.74 |
| C | 0.22 | 0.05 | 0.86 | 0.011 | 0.014 | 1.91 | 0.04 | 0.035 | 0.001 | 0.0184 | 0.0010 | 1.99 |

*represents deviation from the scope of the present invention.

Rolling reduction was applied to each cast piece while being solidified in the continuous casting. Each cast piece was heated under the condition shown in Table 2, and thereafter the cast piece was formed into a square billet of 180 mm×180 mm through the blooming, and then is cooled down to the room temperature. The billets were heated under the condition shown in Table 2, and thereafter, were hot-rolled into rolled steel bars having a diameter of 50 mm, and rolled steel bars having a diameter of 70 mm.

TABLE 2

| Condition No. | Cast Piece: Heating Temperature (° C.) | Cast Piece: Heating Time (minutes) | Billet: Heating Temperature (° C.) | Billet: Heating Time (minutes) | Rolling Condition: Water-cooling before Finish Rolling | Rolling Condition: Finish Rolling Temperature (° C.) | Rolling Condition: Cooling Condition |
|---|---|---|---|---|---|---|---|
| (1) | 1280 | 120 | 1200 | 90 | No | 970 | Allowing-cooling |
| (2) | 1280 | 720 | 1200 | 90 | No | 970 | Allowing-cooling |
| (3) | 1280 | 720 | 1200 | 90 | Yes | 900 | Allowing-cooling |
| (4) | 1280 | 720 | 1200 | 120 | No | 970 | Water-cooling down to 800° C., thereafter allowing-cooling |
| (5) | 1280 | 720 | 1200 | 40 | No | 930 | Allowing-cooling |
| (6) | 1280 | 720 | 1270 | 120 | No | 1050 | Allowing-cooling |
| (7) | 1280 | 720 | 1150 | 90 | No | 900 | Allowing-cooling |
| (8) | 1200 | 720 | 1200 | 90 | No | 970 | Allowing-cooling |

A section (cross section) was formed by cutting each steel bar having a diameter of 50 mm vertically in its longitudinal direction while including its center portion, and thereafter, the cross sectional surface was so mirror-polished and Nital-etched as to be formed as a specimen. Each specimen was then randomly observed in 15 visual fields at the magnification of 400 times. At this time, the observation was randomly carried out in the 15 visual fields in an area excluding a decarburized layer of an outer layer of the cross section. Each visual filed had a size of 250 μm×250 μm. The average ferrite grain diameter was obtained for each visual field through an image analysis in accordance with a common method. The microstructure of every specimen included no martensite structure, and was constituted by any one of the ferrite-pearlite structure, the ferrite-pearlite-bainite structure, or the ferrite-bainite structure.

Figure 2:
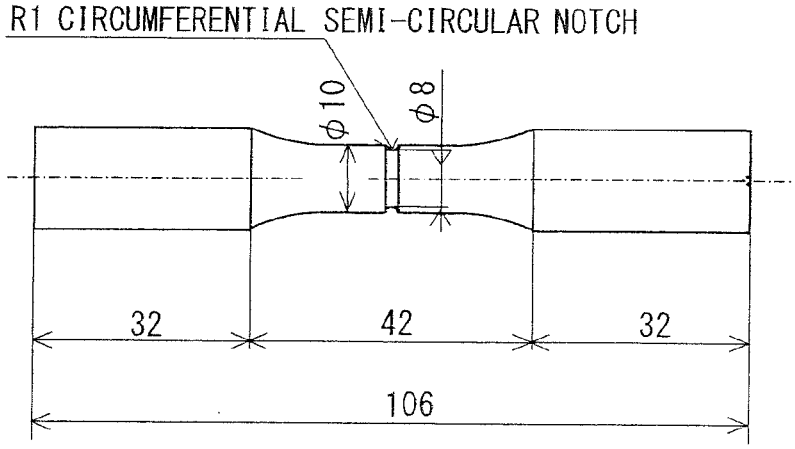
FIG. 2 is a side view showing dimensions and a shape of a notched specimen for the Ono-type rotating bending fatigue test produced in Examples.
Figure 3:
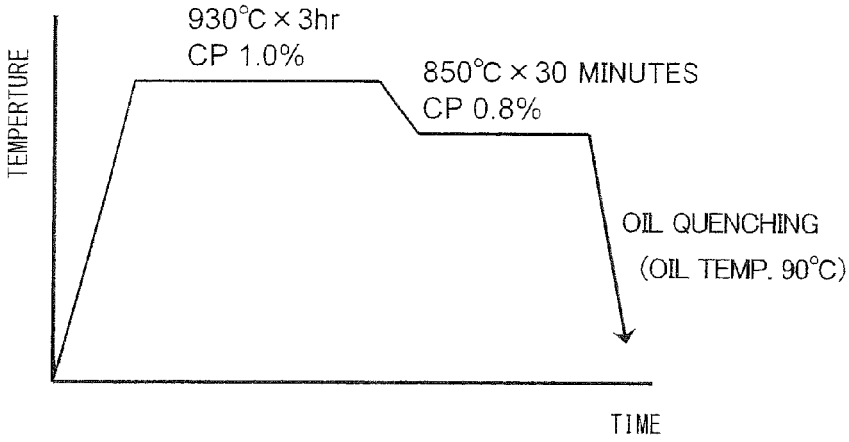
FIG. 3 is a drawing showing a carburizing-quenching condition in Examples.

Each rolled steel bar for hot forging having a diameter of 50 mm, which was produced by using each steel of Table 1 under the condition shown in Table 2, was heated at a temperature of 1200° C. for 30 minutes, and was then hot-forged at a finishing temperature of 950° C. or more, so as to be produced into a round bar having a diameter of 35 mm. Each small roller specimen for a roller pitching test shown in FIG. 1, and each specimen having a notched portion for the Ono-type rotating bending fatigue test having a shape shown in FIG. 2 were produced (measurement unit in both FIG. 1 and FIG. 2 was mm) through machining. Each of the above specimens was carburizing-quenched in a gas carburizing furnace under the condition shown in FIG. 3, and thereafter, was tempered at a temperature of 170° C. for 1.5 hours. Finishing processing was applied to a grip portion of each specimen for the purpose of removing heat-treatment distortion therefrom.

Figure 4:
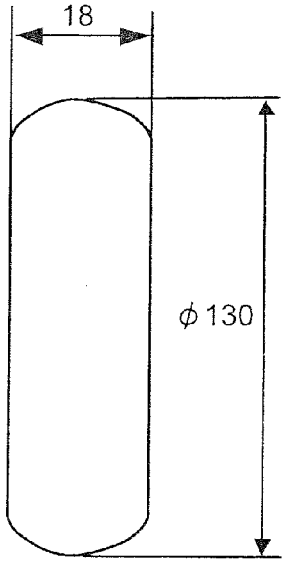
FIG. 4 is a front view showing dimensions and a shape of a large roller used in the roller pitching test of Examples.

The roller pitching test was conducted by using a combination of each of the above described small roller specimens and a large roller having a shape shown in FIG. 4 (measurement unit in each drawing was mm) under the condition shown in Table 3.

TABLE 3

| | |
|---|---|
| Tester | Roller Pitching Tester |
| Specimen | Small Roller ϕ26 mm<br>Large Roller ϕ130 mm (contact part 150 mmR) |
| Max. Contact Pressure | 4000 MPa |
| Number of Tests | 6 |
| Slip Ratio | −40% |
| Rotational Frequency of Small Roller | 1000 rpm |
| Peripheral Speed | Small Roller 1.36 m/s, Large Roller 1.90 m/s |
| Lubricant Temp. | 90° C. |
| Oil for Use | Automatic Transmission Fluid |

The large roller for the roller pitching test was produced by using steel satisfying the specification of SCM420H of JIS standard through a general producing process. Specifically, the large roller was produced through the following producing process: normalizing, machining, eutectoid carburizing using a gas carburizing furnace, low temperature tempering, and polishing.

In the roller pitching test, six pieces for each Test No. were tested. An S-N diagram was generated where an ordinate represents a contact pressure, and an abscissa represents the number of cycles to pitching occurrence. Among test results where no pitching occurred until the number of cycles of $2.0\times10^7$, the greatest contact pressure was defined as the surface fatigue strength. Pitching occurrence was determined if an area of the greatest damage among damages generated on the surfaces of testing portions of the small rollers became 1 $mm^2$ or more.

In the Ono-type rotating bending fatigue test, eight pieces for each Test No. were tested. The rotational frequency was defined at 3000 rpm, and each test was conducted in accordance with a common testing method except for this condition. Among test results where no rupture occurred until the number of cycles of $1.0\times10^4$, and of $1.0\times10^7$, the respective greatest stresses were defined as the medium-cycle rotating bending fatigue strength, and as the high-cycle rotating bending fatigue strength.

The test result of each test above was shown in Table 4 described later. The target value of the surface fatigue strength in the roller pitching test was specified to be 20% or more than 20% greater than the surface fatigue strength in Test No. 1 specified to be 100, where each specimen for Test No. 1 was produced by carburizing the steel A of a conventional steel type that satisfies the specification of SCr420H of JIS standard. The target value of the bending fatigue strength in the Ono-type rotating bending fatigue test was specified to be 15% or more than 15% greater than the medium-cycle rotating bending fatigue strength and the high-cycle rotating bending fatigue strength in Test No. 1 that were respectively specified to be 100, where each specimen for Test No. 1 was produced by carburizing the steel A.

In the cutting test, each rolled steel bar for hot forging having a diameter of 70 mm, which was hot-rolled in the above manner was heated at a temperature of 1200° C. for 30 minutes, and was hot-forged at a finishing temperature of 950° C. or more, so as to be formed into a round bar having a diameter of 50 mm. This round bar was machined into a specimen having a diameter of 46 mm and a length of 400 mm. Each specimen produces in this manner was subjected to the cutting test under the following condition.

Cutting Test (Lathe Turning)

Tip: material quality of base metal was carbide P20 grade, and no coating was applied.

Condition: cutting speed was 200 m/min., feed rate was 0.30 mm/rev., depth of cut was 1.5 mm, and water-soluble cutting fluid was used.

Measurement item: amount of flank wear at major cutting edge after ten minutes of cutting time.

The test result of each test above was shown in Table 4. The target value in the cutting test was specified to have amount of flank wear at the major cutting edge of 200 or more than 20% smaller than that in Test No. 2 specified to be 100, where Test No. 2 was produced by carburizing the steel B that is a conventional high strength material satisfying the specification of SCM822H of JIS standard.

TABLE 4

| Test No. | Classification | Steel | Table 2/ Producing Condition | Microstructure | Average Ferrite Grain Diameter Max./Min. | Medium-cycle/Bending Fatigue Strength (Specified) | High-cycle/Bending Fatigue Strength (Specified) | Surface Fatigue Strength (Specified) | Cutting Test/ Wear Amount at Main Cutting Edge (Specified) |
|---|---|---|---|---|---|---|---|---|---|
| 1 | Comparative Ex. | *A | (2) | F + P | 1.5 | Standard (100) | Standard (100) | Standard (100) | 70 |
| 2 | Comparative Ex. | *B | (2) | F + P + B | 1.7 | #112 | #112 | 120 | Standard (100) |
| 3 | Comparative Ex. | C | (1) | F + P + B | *2.3 | #112 | 118 | 120 | 75 |
| 4 | Inventive Ex. | C | (2) | F + P + B | 1.7 | 120 | 120 | 130 | 70 |
| 5 | Comparative Ex. | C | (3) | F + P + B | *2.2 | #114 | 118 | 120 | 75 |
| 6 | Comparative Ex. | C | (4) | F + P + B | *2.8 | #102 | #112 | #115 | 75 |
| 7 | Comparative Ex. | C | (5) | F + P + B | *2.4 | #110 | 116 | 120 | 75 |
| 8 | Comparative Ex. | C | (6) | F + B | *3.2 | #104 | #114 | #110 | 75 |
| 9 | Inventive Ex. | C | (7) | F + P + B | 1.3 | 125 | 120 | 130 | 70 |
| 10 | Comparative Ex. | C | (8) | F + P + B | *2.1 | #114 | 118 | 125 | 70 |

*represents deviation from the scope of the present invention.

#represents that the target of the present invention is not achieved.

As show in Table 4, in each test for Test No. that deviated from the condition specified by the present invention, at least one of the target bending fatigue strength, surface fatigue strength, and machinability was not achieved.

In each test for Test No. that satisfied the condition specified by the present invention, the target bending fatigue strength, surface fatigue strength, and machinability were all achieved.

Example 2

Quality governing was applied to steels D to T having the chemical compositions shown in Table 5 in the 70-ton converter, and rectangular cast pieces of 400 mm×300 mm were produced through continuous casting, and were cooled down to not more than 600° C.

TABLE 5

| | Chemical Composition (weight %) Balance: Fe and Inevitable Impurities | | | | | | | | | | | | | | |
|---|---|---|---|---|---|---|---|---|---|---|---|---|---|---|---|
| Steel | C | Si | Mn | P | S | Cu | Ni | Cr | Mo | Al | Nb | Ti | N | O | Cr + 2 · Mo |
| D | 0.21 | *0.14 | 0.81 | 0.014 | 0.015 | — | — | 1.86 | 0.02 | 0.033 | — | 0.002 | 0.0153 | 0.0010 | 1.90 |
| E | 0.22 | 0.05 | 0.85 | 0.012 | 0.013 | — | — | 1.76 | — | 0.035 | — | 0.002 | 0.0167 | 0.0009 | *1.76 |
| F | 0.21 | 0.06 | 0.82 | 0.013 | 0.014 | — | — | 1.62 | 0.08 | 0.034 | — | 0.002 | 0.0155 | 0.0011 | *1.78 |
| G | 0.21 | 0.04 | 0.79 | 0.014 | 0.015 | — | — | 1.75 | 0.04 | 0.030 | — | 0.001 | 0.0151 | 0.0012 | 1.83 |
| H | 0.22 | 0.05 | 0.82 | 0.015 | 0.013 | — | — | 1.82 | — | 0.031 | — | 0.002 | 0.0139 | 0.0011 | 1.82 |
| I | 0.20 | 0.09 | 0.71 | 0.011 | 0.015 | — | — | 1.92 | 0.08 | 0.035 | — | 0.001 | 0.0182 | 0.0009 | 2.08 |
| J | 0.21 | 0.07 | 0.69 | 0.016 | 0.013 | — | — | 2.00 | 0.02 | 0.029 | — | 0.001 | 0.0152 | 0.0011 | 2.04 |
| K | 0.20 | 0.07 | 0.73 | 0.014 | 0.013 | — | — | *2.13 | — | 0.034 | — | 0.002 | 0.0176 | 0.0013 | *2.13 |
| L | 0.21 | 0.06 | 0.72 | 0.012 | 0.013 | — | — | 1.98 | 0.09 | 0.037 | — | 0.002 | 0.0163 | 0.0011 | *2.16 |
| M | 0.21 | 0.08 | 0.83 | 0.016 | 0.014 | — | — | 1.68 | *0.16 | 0.033 | — | 0.002 | 0.0154 | 0.0012 | 2.00 |
| N | 0.21 | 0.03 | 0.70 | 0.013 | 0.012 | — | — | 1.85 | 0.06 | 0.033 | 0.031 | 0.001 | 0.0185 | 0.0009 | 1.97 |
| O | 0.22 | 0.04 | 0.72 | 0.011 | 0.013 | — | — | 1.92 | 0.03 | 0.038 | 0.036 | 0.001 | 0.0176 | 0.0011 | 1.98 |
| P | 0.20 | 0.07 | 0.72 | 0.013 | 0.015 | — | — | 1.84 | 0.03 | *0.021 | — | 0.002 | 0.0141 | 0.0010 | 1.90 |
| Q | 0.21 | 0.08 | 0.73 | 0.012 | 0.013 | — | — | 1.85 | 0.03 | *0.056 | — | 0.001 | 0.0149 | 0.0009 | 1.91 |
| R | 0.21 | 0.06 | 0.82 | 0.012 | 0.013 | 0.16 | — | 1.79 | 0.05 | 0.032 | — | 0.001 | 0.0172 | 0.0011 | 1.89 |
| S | 0.21 | 0.04 | 0.84 | 0.013 | 0.012 | — | 0.22 | 1.89 | 0.07 | 0.035 | — | 0.001 | 0.0162 | 0.0010 | 2.03 |
| T | 0.22 | 0.07 | 0.78 | 0.014 | 0.011 | 0.18 | 0.41 | 1.88 | — | 0.037 | — | 0.001 | 0.0179 | 0.0008 | 1.88 |

*represents deviation from the scope of the present invention.

Rolling reduction was applied to each steel while being solidified in the continuous casting. Each cast piece was heated under the condition shown in Table 2, and thereafter the cast piece was formed into a square billet of 180 mm×180 mm through the blooming, and then was cooled down to the room temperature. Subsequently, the billets were heated under the condition shown in Table 2, and thereafter, were hot-rolled into steel bars having a diameter of 50 mm and 70 mm under the condition shown in Table 2. The investigation item and the investigation method were the same as those described in Example 1.

The test result of each test was shown in Table 6.

TABLE 6

| Test No. | Classification | Steel | Table 2/ Producing Condition | Microstructure | Average Ferrite Grain Diameter Max./Min. | Medium-cycle/ Bending Fatigue Strength (Specified) | High-cycle/ Bending Fatigue Strength (Specified) | Surface Fatigue Strength (Specified) | Cutting Test/ Wear Amount at Main Cutting Edge (Specified) |
|---|---|---|---|---|---|---|---|---|---|
| 11 | Comparative Ex. | *D | (2) | F + P + B | 1.6 | #110 | #110 | 125 | 75 |
| 12 | Comparative Ex. | *D | (1) | F + P + B | *2.2 | #104 | #106 | 120 | 75 |
| 13 | Comparative Ex. | *E | (2) | F + P + B | 1.7 | #112 | #114 | #115 | 70 |
| 14 | Comparative Ex. | *E | (3) | F + P | 1.8 | #106 | #108 | #110 | 70 |
| 15 | Comparative Ex. | *F | (2) | F + P + B | 1.6 | #114 | #112 | #115 | 75 |
| 16 | Comparative Ex. | *F | (4) | F + P + B | *2.3 | #108 | #108 | #110 | 75 |
| 17 | Inventive Ex. | G | (2) | F + P + B | 1.5 | 118 | 120 | 120 | 70 |
| 18 | Comparative Ex. | G | (1) | F + P + B | *2.2 | #112 | 116 | #115 | 70 |
| 19 | Inventive Ex. | H | (7) | F + P | 1.3 | 120 | 118 | 125 | 70 |
| 20 | Comparative Ex. | H | (3) | F + P + B | *2.3 | #112 | #114 | 120 | 70 |
| 21 | Inventive Ex. | I | (2) | F + B | 1.7 | 126 | 122 | 130 | 80 |
| 22 | Comparative Ex. | I | (4) | F + P + B | *2.6 | #114 | 118 | 125 | 80 |
| 23 | Inventive Ex. | J | (7) | F + P + B | 1.6 | 126 | 122 | 130 | 80 |
| 24 | Comparative Ex. | J | (5) | F + P + B | *2.4 | #114 | 116 | 125 | 80 |
| 25 | Comparative Ex. | *K | (7) | F + P + B | 1.7 | 126 | 124 | 130 | #105 |
| 26 | Comparative Ex. | *K | (5) | F + P + B | *2.5 | 116 | 118 | 125 | #105 |
| 27 | Comparative Ex. | *L | (2) | F + B | 1.7 | 126 | 122 | 130 | #110 |
| 28 | Comparative Ex. | *L | (6) | F + B | *2.7 | #114 | #114 | 125 | #110 |
| 29 | Comparative Ex. | *M | (2) | F + B | 1.7 | 122 | 120 | 125 | #105 |
| 30 | Comparative Ex. | *M | (8) | F + B | *2.5 | #112 | #114 | 120 | #105 |
| 31 | Inventive Ex. | N | (7) | F + P + B | 1.4 | 128 | 124 | 130 | 75 |
| 32 | Comparative Ex. | N | (6) | F + B | *2.4 | #114 | 118 | 125 | 75 |
| 33 | Inventive Ex. | O | (2) | F + P + B | 1.4 | 128 | 126 | 130 | 75 |
| 34 | Comparative Ex. | O | (8) | F + P + B | *2.2 | #114 | 116 | 125 | 75 |
| 35 | Comparative Ex. | *P | (2) | F + P + B | 1.7 | #112 | 120 | 125 | 70 |
| 36 | Comparative Ex. | *P | (4) | F + P + B | *2.6 | #110 | #112 | 120 | 70 |
| 37 | Comparative Ex. | *Q | (2) | F + P + B | 1.7 | 118 | #114 | 125 | 70 |
| 38 | Comparative Ex. | *Q | (6) | F + P + B | *2.3 | #108 | #110 | #115 | 70 |
| 39 | Inventive Ex. | R | (2) | F + P + B | 1.5 | 120 | 122 | 125 | 75 |
| 40 | Inventive Ex. | S | (2) | F + P + B | 1.4 | 126 | 124 | 130 | 80 |
| 41 | Inventive Ex. | T | (2) | F + P + B | 1.5 | 122 | 122 | 125 | 75 |

*represents deviation from the scope of the present invention.
#represents that the target of the present invention is not achieved.

As show in Table 6, in each test for Test No. that deviated from the condition specified by the present invention, at least one of the target bending fatigue strength, surface fatigue strength, and machinability was not achieved.

In each test for Test No. that satisfied the condition specified by the present invention, the target bending fatigue strength, surface fatigue strength, and machinability were all achieved. The tests for Test No. 31 and Test No. 33 containing Nb had results significantly exceeding the target value. The tests for Test No. 39 to Test No. 41 containing at least one of Cu and Ni had results significantly exceeding the target value.

The embodiment of the present invention has been explained as described above, but the aforementioned embodiment was nothing but an example for carrying out the present invention. Accordingly, the present invention is not limited to the aforementioned embodiment, and various modifications and variations of the aforementioned embodiment may be carried out without departing from the scope of the invention.

The invention claimed is:

1. A rolled steel bar or a wire rod for hot forging comprising:

a composition containing, in mass %,

C: 0.1 to 0.25%,

Si: 0.01 to 0.10%,

Mn: 0.4 to 1.0%,

S: 0.003 to 0.05%,

Cr: 1.60 to 2.00%,

Mo: 0.10% or less (including 0%),

Al: 0.025 to 0.05%, and

N: 0.010 to 0.025%, contents of Cr and Mo satisfying $1.82 \leq fn1 \leq 2.10$ if a value of fn1 expressed by a following formula (1) is given:

$$fn1 = Cr + 2 \times Mo \quad (1),$$

where an symbol of each element in the formula (1) represents a content of the element in mass %;

a balance being Fe and impurities having a composition containing P: 0.025% or less, Ti: 0.003% or less, and O (oxygen): 0.002% or less;

a structure including any one of a ferrite-pearlite structure, a ferrite-pearlite-bainite structure, and a ferrite-bainite structure; and a cross section in which a maximum value/a minimum value of an average ferrite grain diameter is 2.0 or less when measurement by observation is randomly carried out in 15 visual fields with an area per visual field set to be 62500 $\mu m^2$.

2. The rolled steel bar or the wire rod for hot forging according to claim 1, wherein the rolled steel bar or the wire rod contains Nb: 0.08% or less in mass % instead of part of Fe.

3. The rolled steel bar or the wire rod for hot forging according to claim 1, wherein the rolled steel bar or the wire rod contains at least one of Cu: 0.4% or less and Ni: 0.8% or less in mass % instead of part of Fe.

4. The rolled steel bar or the wire rod for hot forging according to claim 2, wherein the rolled steel bar or the wire rod contains at least one of Cu: 0.4% or less and Ni: 0.8% or less in mass % instead of part of Fe.

* * * * *